US011274403B2

(12) United States Patent
Koseki et al.

(10) Patent No.: US 11,274,403 B2
(45) Date of Patent: Mar. 15, 2022

(54) RAMMER

(71) Applicant: SAKAI HEAVY INDUSTRIES, LTD., Tokyo (JP)

(72) Inventors: Tetsuya Koseki, Saitama (JP); Dekun Wang, Shanghai (CN)

(73) Assignee: SAKAI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 16/965,992

(22) PCT Filed: Dec. 12, 2018

(86) PCT No.: PCT/JP2018/045687
§ 371 (c)(1),
(2) Date: Jul. 29, 2020

(87) PCT Pub. No.: WO2019/146298
PCT Pub. Date: Aug. 1, 2019

(65) Prior Publication Data

US 2021/0032818 A1 Feb. 4, 2021

(30) Foreign Application Priority Data

Jan. 29, 2018 (JP) ..... JP2018-012740

(51) Int. Cl.
*E01C 19/00* (2006.01)
*E01C 19/35* (2006.01)
(Continued)

(52) U.S. Cl.
CPC ..... *E01C 19/35* (2013.01); *B06B 1/12* (2013.01); *E01C 19/38* (2013.01); *E01C 21/00* (2013.01); *E02D 3/046* (2013.01)

(58) Field of Classification Search
CPC ..... E01C 19/35; E01C 19/38; E01C 21/00; E02D 3/046; B06B 1/12
(Continued)

(56) References Cited

U.S. PATENT DOCUMENTS 3,277,801 A * 10/1966 Horvath ..... E02D 3/068 404/133.1
3,814,533 A * 6/1974 Buck ..... E02D 3/074 404/133.1
(Continued)

FOREIGN PATENT DOCUMENTS

JP S37002947 5/1962
JP S4995403 A 9/1974
(Continued)

*Primary Examiner* — Raymond W Addie
(74) *Attorney, Agent, or Firm* — CRGO Global; Steven M. Greenberg

(57) ABSTRACT

A rammer includes: an engine; a reciprocating mechanism (3) including a crank shaft (13) and a connecting rod (14), and configure to convert a rotational force of the engine into a reciprocatory force; a leg part disposed in a forward inclined position in a traveling direction and configure to be moved up and down by the connecting rod (14); and a compacting plate disposed on a bottom end of the leg part. The crank shaft (13) is disposed orthogonally to the traveling direction. The reciprocating mechanism (3) includes a belt reduction mechanism (16) and a gear reduction mechanism (17).

3 Claims, 5 Drawing Sheets

(51) Int. Cl.

| | |
|---|---|
| ***B06B 1/12*** | (2006.01) |
| ***E01C 19/38*** | (2006.01) |
| ***E01C 21/00*** | (2006.01) |
| ***E02D 3/046*** | (2006.01) |

(58) Field of Classification Search
USPC ..... 404/133.05–133.1
See application file for complete search history.

(56) References Cited

U.S. PATENT DOCUMENTS

| | | | | |
|---|---|---|---|---|
| 3,878,733 | A * | 4/1975 | Tertinek | E02D 3/074 404/113 |
| 3,899,262 | A * | 8/1975 | Yamamoto | E02D 3/068 404/133.1 |
| 3,972,637 | A * | 8/1976 | Sutherland | E02D 3/074 404/133.1 |
| 4,015,909 | A * | 4/1977 | Yamamoto | E02D 3/068 404/133.1 |
| 4,186,197 | A * | 1/1980 | Tetsuo | E02D 3/068 404/133.1 |
| 6,443,651 | B1 | 9/2002 | Greppmair | |
| 2015/0167259 | A1* | 6/2015 | Steffen | E02D 3/046 404/133.1 |
| 2016/0032548 | A1* | 2/2016 | Braun | E02D 3/046 404/133.1 |
| 2021/0040700 | A1* | 2/2021 | Koseki | E01C 19/35 |

FOREIGN PATENT DOCUMENTS

| | | |
|---|---|---|
| JP | S50006082 | 3/1975 |
| JP | S60169309 | 11/1985 |
| JP | S62185705 | 11/1987 |
| JP | H11140815 A | 5/1999 |
| JP | 2001003310 | 1/2001 |
| JP | 2011001772 | 1/2011 |

* cited by examiner

RAMMER

CROSS-REFERENCE TO RELATED APPLICATIONS

This application is a § 371 national phase entry of International Application No. PCT/JP2018/045687, filed Dec. 12, 2018, which claims priority to Japanese Patent Application No. 2018-012740, filed Jan. 29, 2018.

TECHNICAL FIELD

The present invention relates to a rammer.

BACKGROUND OF THE INVENTION

There has been a conventional rammer which includes an engine, a reciprocating mechanism which converts a rotative force of the engine into a reciprocatory force, a leg part disposed in a forward inclined position in a traveling direction and being moved up and down by the reciprocating mechanism, and a compacting plate disposed on the bottom end of the leg part.

The reciprocating mechanism includes a crank mechanism where a pinion gear of an output shaft of the engine is engaged with a crank gear of a crank shaft. The crank gear is provided with a crank pin at a position offset from the rotational axis of the crank shaft, and a connecting rod is connected to the crank pin. The crank shaft is disposed along a body in the front-rear direction (in detail, inclined forward and downward in the front-rear direction), and a connecting rod rotates while repeatedly changing its position in a right-left direction of the body.

PRIOR ART REFERENCE

Patent Document

Patent Document 1: Japanese Patent Application Publication No. JP1999-140815

SUMMARY OF THE INVENTION

Problem to be Solved by the Invention

Patent Document 1 has issues as follows:

(1) the connecting rod changes its position in a right-left direction of the body, and the body also vibrates in the right-left direction, and thus a forward movement of the body may be unstable;

(2) one-step reduction by using the pinion gear and crank gear engaged with each other reduces the number of teeth, thereby making it difficult to ensure a strength and an abrasion resistance of the pinion gear;

(3) a structure where the engine is rigidly fixed on a case in the reciprocating mechanism tends to directly transmit a vibration to the engine during the compaction work; and (4) the crank shaft has a cantilever support structure where only the one end of the crank shaft is rotatably supported by the case in the reciprocating mechanism, and the crank shaft tends to be flexed. Thus, an impact tends to forcedly exert on the mesh part between the pinion gear and the crank gear.

The invention herein provides a rammer having an excellent forward movement of the body to address such issues.

Means of Solving the Problem

The present invention includes: an engine; a reciprocating mechanism including a crank shaft and a connecting rod and configured to convert a rotational force of the engine into a reciprocatory force; a leg part disposed in a forward inclined position in a traveling direction and configured to be moved up and down by the connecting rod; and a compacting plate disposed on the bottom end of the leg part. The crank shaft has a rotational axis disposed to be orthogonally to the traveling direction.

In the present invention, the connecting rod change its position in a front-rear direction of the rammer, and a vibration of the rammer in a right-left direction is reduced while the rammer moves forward, and the gyro effect allows the rammer to stably jump forward.

The reciprocating mechanism of the present invention includes: a driving pulley rotatably attached on an output shaft of the engine; a driven pulley larger in diameter than the driving pulley; a belt reduction mechanism including a belt wound between the driving pulley and the driven pulley; a pinion gear configured to rotate integrally with the driven pulley; and a gear reduction mechanism having a large diameter gear disposed on the crank shaft and being engaged with the pinion gear.

A two-step reduction mechanism of the present invention reduces a rotation speed by using the belt reduction mechanism alone. This allows a teeth number of the pinion gear of the gear reduction mechanism to be increased, thereby improving a strength and an abrasion resistance of the pinion gear. The belt slips in the belt reduction mechanism when being overloaded, thereby protecting the engine and the reciprocating mechanism.

The engine of the present invention is disposed apart rearward from a case of the reciprocating mechanism and disposed on a plate member extending rearward from the lower part of the case.

In the present invention, while the engine is pushed up from a ground under an impact force during compaction work, the plate member is flexed to reduce the impact force and the reduced impact force is transmitted to the engine. This allows the engine to be protected.

The present invention includes a gear shaft. The driven pulley is rotatably attached on one end side of the gear shaft and the pinion gear disposed on the other end side of the gear shaft. Both ends of the gear shaft and both ends of the crank shaft are rotatably supported by the case.

A structure of the present invention, where both the ends of the gear shaft and the ends of the crank shaft are supported by the case, allows the pinion gear and the large diameter gear to be stably engaged together.

Effect of the Invention in the present invention, the connecting rod changes its position in a front-rear direction of the rammer, the vibration of the rammer in a right-left direction, while the rammer moves forward, is reduced, and the gyro effect improves the rammer in stability of forward movement.

EMBODIMENTS OF THE INVENTION

Figure 1:
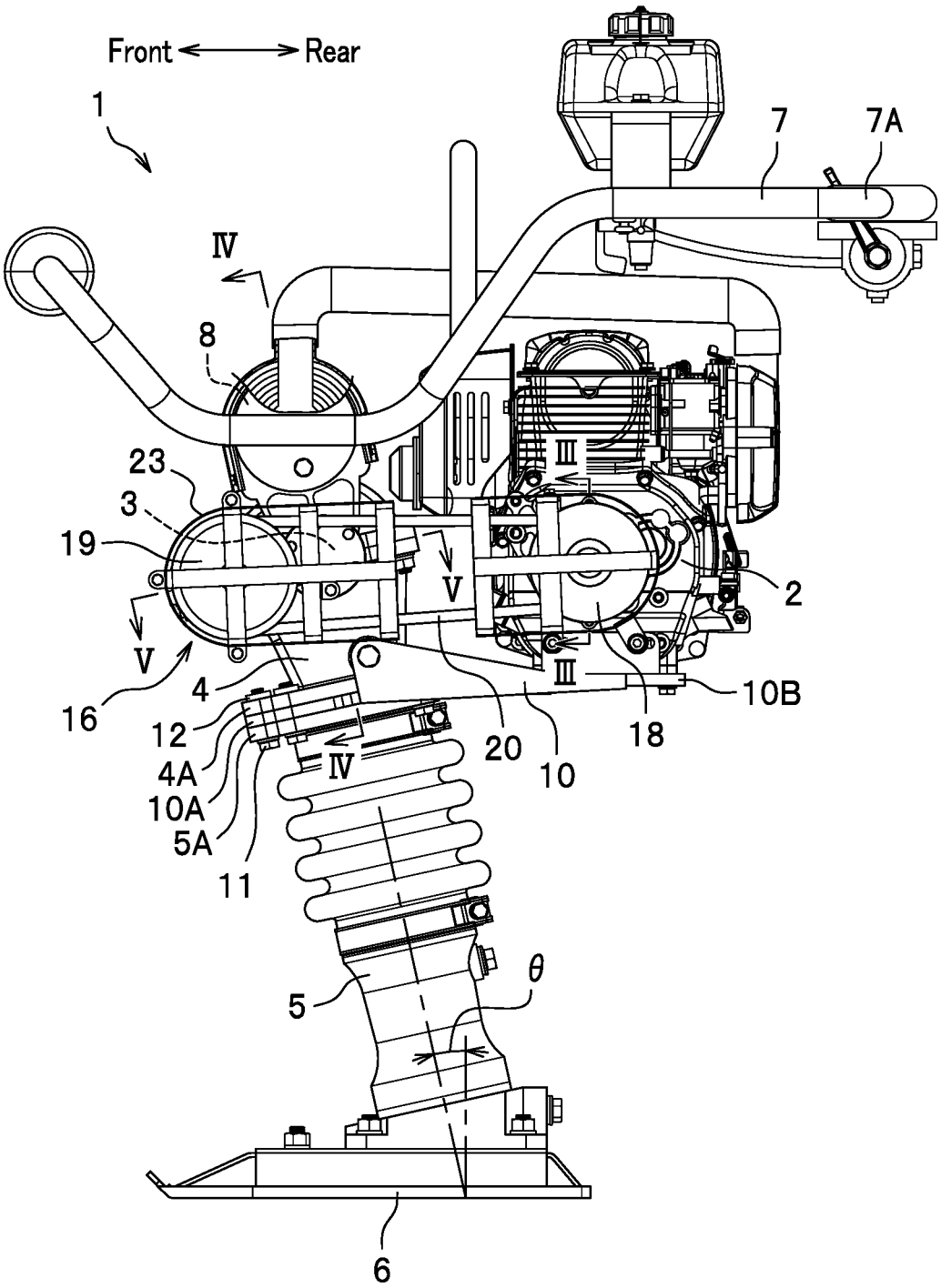
FIG. 1 is a side view of a rammer according to the present invention.
Figure 2:
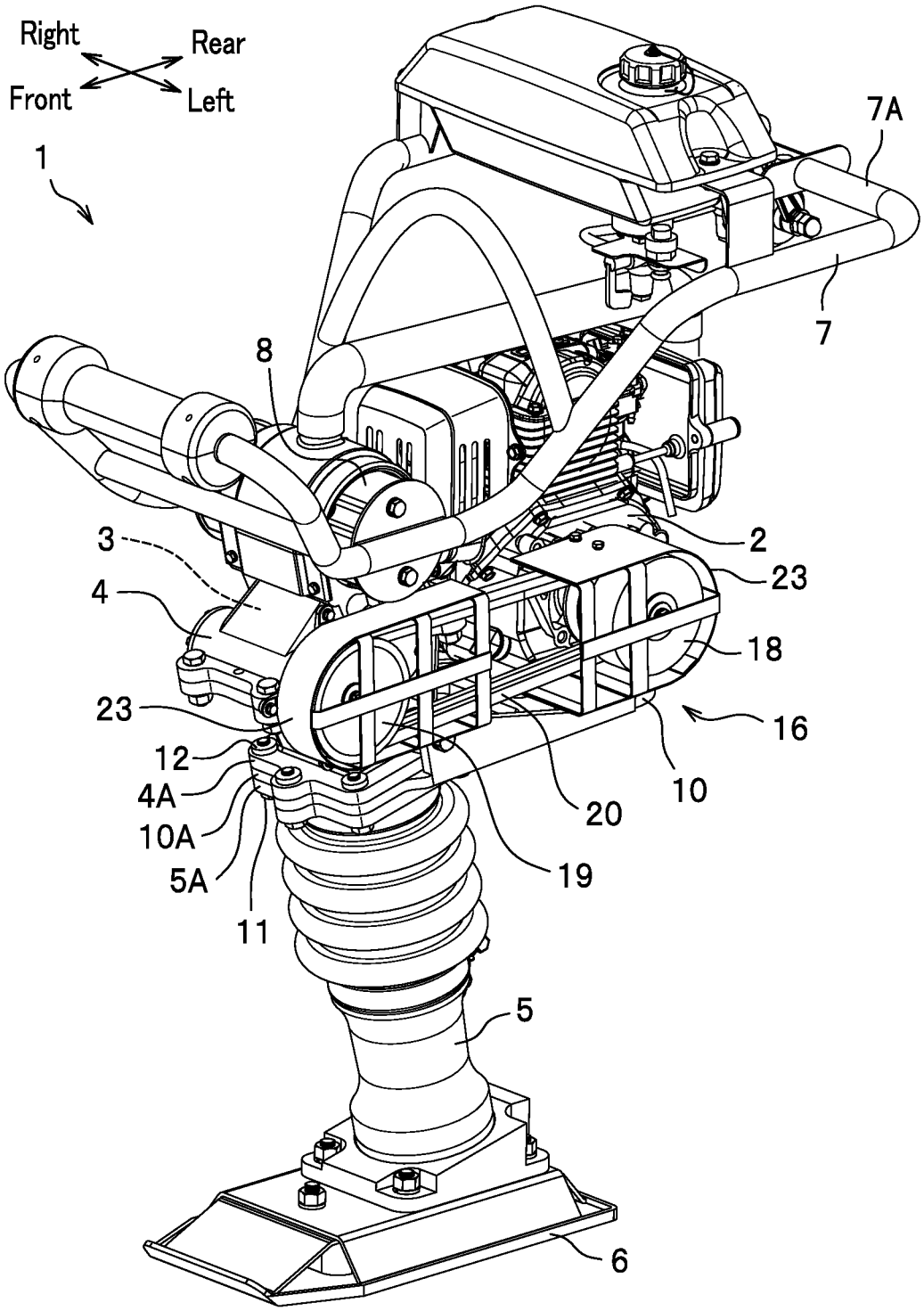
FIG. 2 is a perspective view of an appearance of the rammer according to the present invention.

A rammer 1, as shown in FIGS. 1 and 2, includes; an engine 2; a reciprocating mechanism 3 which converts a rotational force of the engine 2 into a reciprocatory force; a case 4 which receives the reciprocating mechanism; a leg part 5 disposed in a forward inclined position in a traveling direction and being movable up and down; a compacting plate 6 disposed at the bottom end of the leg part 5, and a handle 7 for steering.

Figure 4:
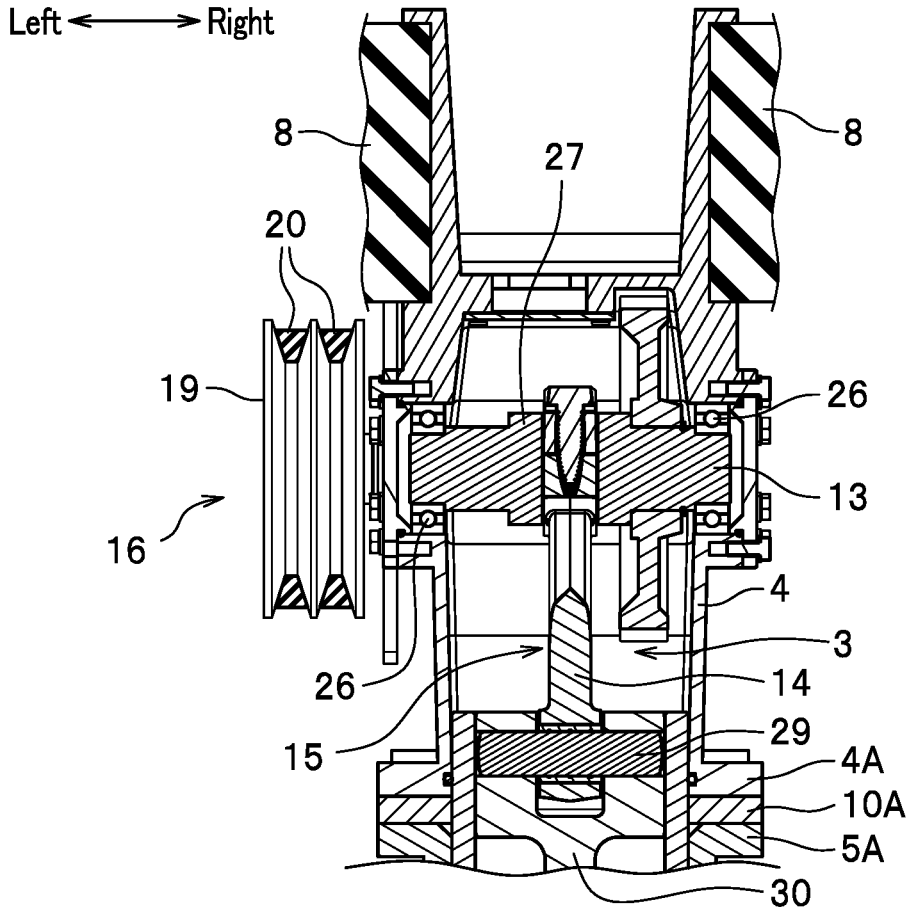
FIG. 4 is a cross-sectional view taken along the □-□ of FIG. 1.

The leg part 5 is disposed in a forward inclined position at a degree of θ to a vertical direction and includes a cylinder mechanism (not shown) including a coiled spring inside an inner cylinder and an outer cylinder. As shown in FIG. 4, the coiled spring expands and contracts up and down by up-down movement of a piston 30 connected to a connecting rod 14, and the inner cylinder moves up and down relative to the outer cylinder.

Such a cylinder mechanism, as described in the reference above, is a conventional one, and omitted from the figures.

The handle 7, as shown in FIGS. 1 and 2, is attached to the both sides of the upper part of the case 4 via an anti vibration rubber 8. The handle 7 is made of a material such as a steel pipe. The handle 7 is a quadrangular frame which surrounds the case 4 and the engine 2 in a plan view. The handle 7 includes a gripping part 7A at the rear end which an operator grips.

Figure 3:
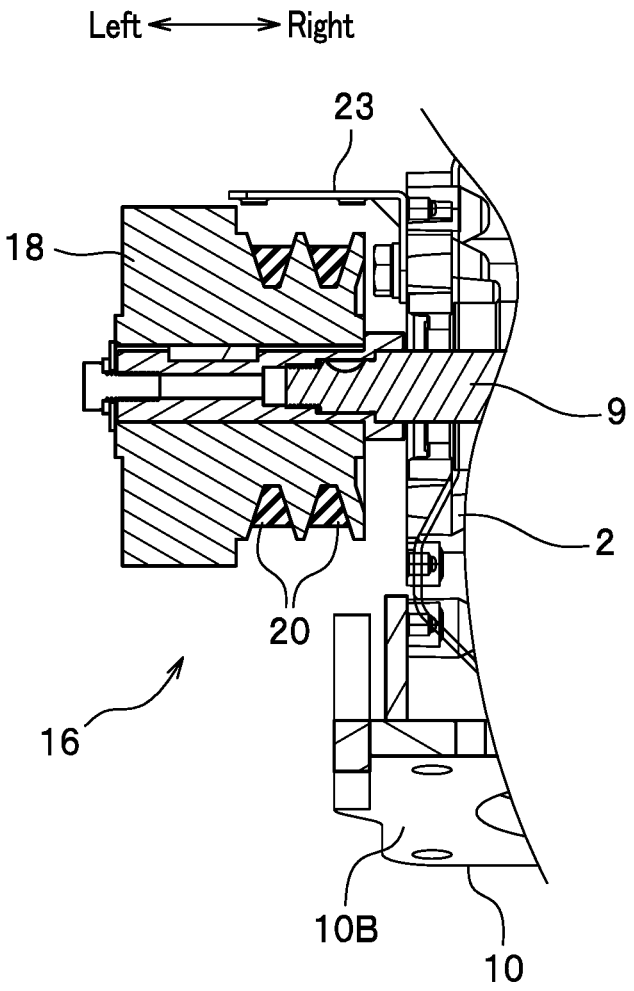
FIG. 3 is a cross-sectional view taken along the □-□ of FIG. 1.
Figure 6:
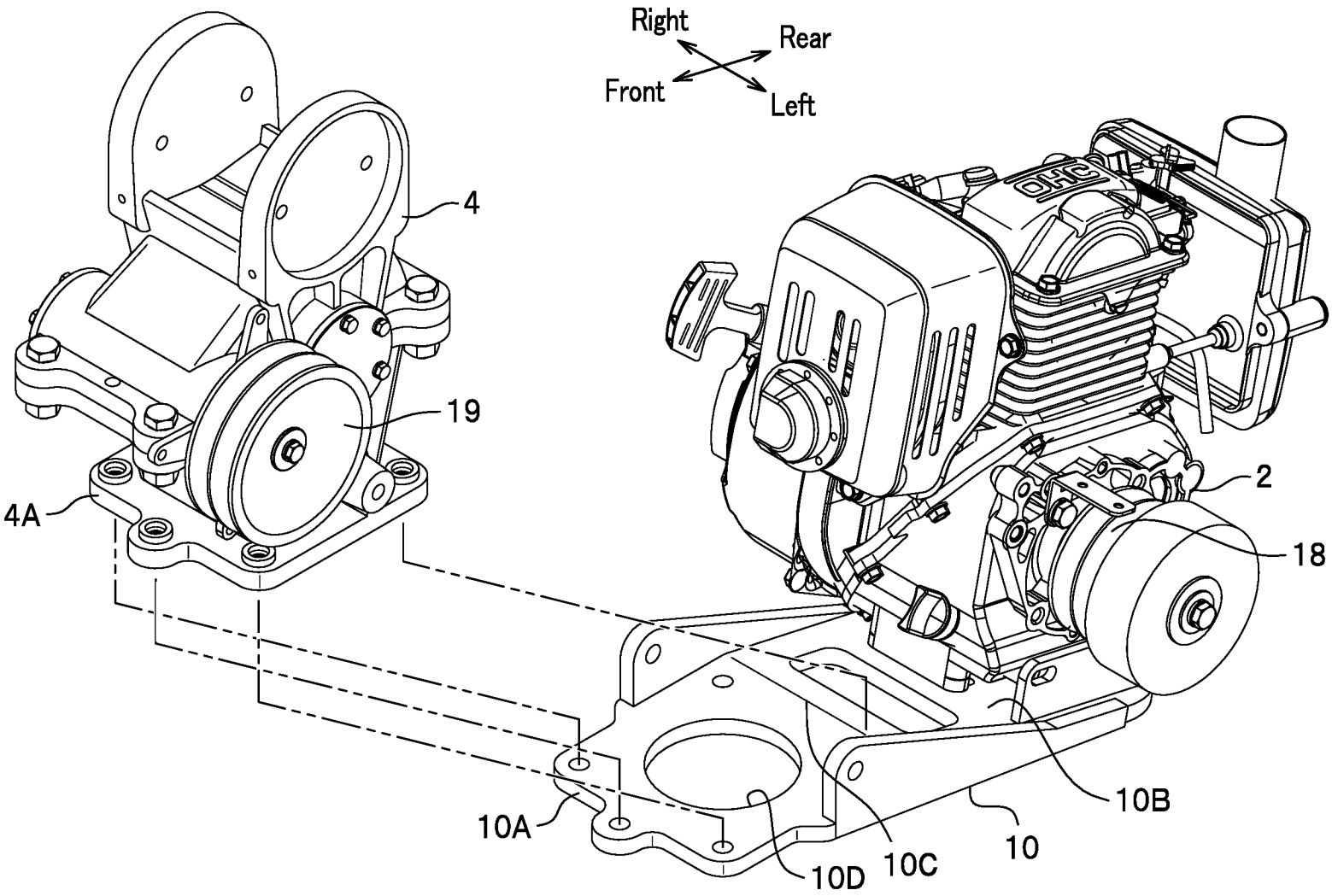
FIG. 6 is a partially exploded perspective view showing a rammer according to the present invention.

The engine 2 is a gasoline engine as an example. The engine 2 includes an output shaft 9 (see FIG. 3) extending from the lower part of the engine in a lateral direction and disposed to extend leftward. That is, the engine 2 is disposed such that the output shaft 9 extends in a right-left direction. The engine 2 is arranged apart backward from the case 4 and disposed on a plate member 10 extending backward from the lower part of the case 4. The plate member 10, with reference to FIG. 6 as well, includes: a fixing part 101 in a forward inclined manner which is held between a lower flange 4A of the case 4 and an upper flange 5A of the leg part 5 and fastenedly fixed with bolts 11 and nuts 12. The plate member 10 includes an engine disposed part 10B on which the engine 2 is disposed. The engine disposed part 10B extends horizontally from the rear part of the fixing part 10A via a bent part 10C which is bent such that the ridge line is formed to extend in a right-left direction. The fixing part 10A defines a through hole 10D through which the connecting rod 14 passes.

"Reciprocating Mechanism 3"

Figure 5:
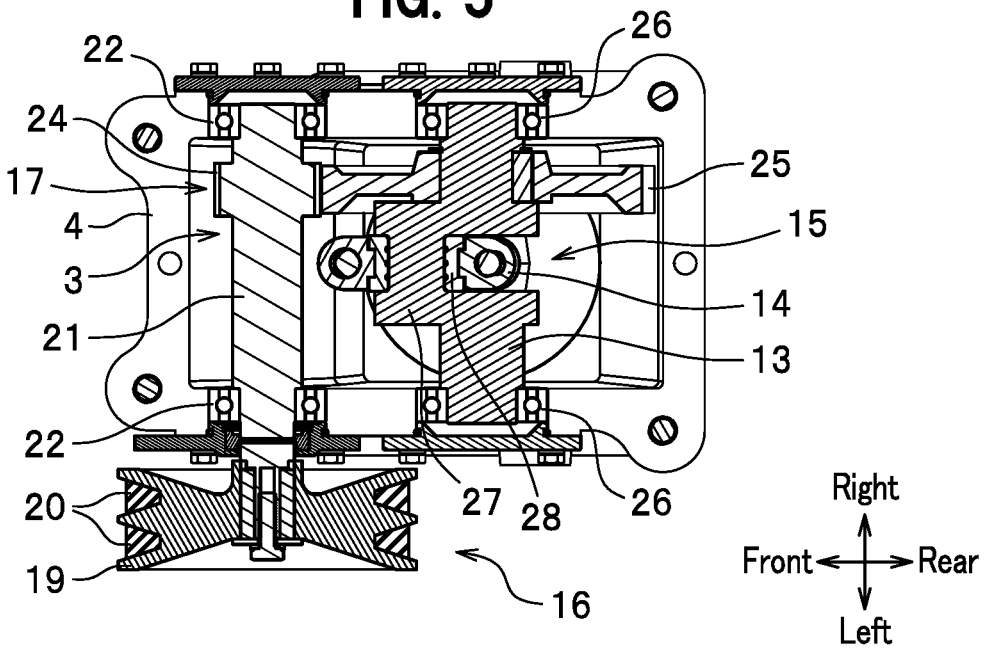
FIG. 5 is a cross-sectional view taken along the □-□ of FIG. 1.

The reciprocating mechanism 3, as shown in FIGS. 4 and 5, includes a crank mechanism 15 which includes a crank shaft 13 and the connecting rod 14. The reciprocating mechanism 3 of this embodiment includes a belt reduction mechanism 16 and a gear reduction mechanism 17.

The belt reduction mechanism 16 includes: a driving pulley 18 rotatably attached on the output shaft 9 of the engine 2 (see FIG. 3); a driven pulley 19 larger than the driving pulley 18 in diameter; and a belt 20 wound between the driving pulley 18 and the driven pulley 19. As shown in FIG. 5, a gear shaft 21, whose rotational axis is set in a right-left direction, is disposed inside the case 4. Both the ends of the gear shaft 21 are rotatably supported by the case 4 by using bearings 22. The left end side of the gear shaft 21 protrudes outside from the case 4. The driven pulley 19 is rotatably attached on the protrusion of the gear shaft 21. That is, the belt 20 is wound between the driving pulley 18 and the driven pulley 19, each rotational axis of which is set in a right-left direction, and is disposed at the left of the engine 2 and case 4 so as to be arranged in a front-rear direction. The engine 2 and case 4, as shown in FIGS. 1 and 2, are provided with a cover 23, which protects the belt reduction mechanism 16, by using an object such as a bracket.

In FIG. 5, the gear reduction mechanism 17 includes a pinion gear 24 to rotate integrally with the driven pulley 19 and a large diameter gear 25 engaged with the pinion gear 24 attached on the crank shaft 13. The pinion gear 24 is formed integrally on the gear shaft 21 and closer to the right end of the gear shaft 21 and has the same axis as the gear shaft 21.

The crank shaft 13 is disposed behind the gear shaft 21 with the rotational axis of the crank shaft 13 set in the right-left direction orthogonal to the traveling direction of the rammer 1. Both the ends of the crank shaft 13 are rotatably supported by the case 4 by using bearings 26. The large diameter gear 25 is rotatably attached on the crank shaft 13 and near the right end of the crank shaft 13. The crank shaft 13 is formed with a crank pin 27, which is being offset from the rotational axis of the crank shaft 13, at the central portion in the axial direction. The crank pin 27 is connected to the upper part of the connecting rod 14 via a bush 28. The lower part of the connecting rod 14, as shown in FIG. 4, is connected to the piston 30 of the cylinder mechanism by using a pin 29.

"Operation"

When the output shaft 9 of the engine 2 rotates, the gear shaft 21 rotates while being decelerated by the belt reduction mechanism 16, and then the crank shaft 13 rotates while being decelerated by the gear reduction mechanism 17. As described above, a crank movement of the connecting rod 14 results in an up-down movement of the piston 30, so that the coiled spring expands and contracts up and down, and the inner cylinder moves up and down relative to the outer cylinder. Thereby, the compacting plate 6 firmly compacts a ground.

The present disclosure serves the following functions and effects.

(1) The crank shaft 13 is disposed such that the rotational axis of the crank shaft 13 is set in a right-left direction, or an orthogonal direction to the traveling direction of the rammer 1. This causes the connecting rod 14 to change its position in the front-rear direction of the rammer 1, the rammer 1 is reduced in the vibration in a right-left direction during the forward travel, and the rammer 1 stably jumps forward by the gyro effect.

(2) A reduction mechanism of the reciprocating mechanism 3 has the two-step reduction having the belt reduction mechanism 16 in addition to the gear reduction mechanism 17. Deceleration by the belt reduction mechanism 16 ensures a larger teeth number of the pinion gear 24 of the gear reduction mechanism 17. This improves a strength and an abrasion resistance of the pinion gear 24. In addition, the belt 20 slips when being overloaded, and thus the engine 2 and the reciprocating mechanism 3 are protected.

(3) The engine 2 is disposed apart rearward from the case 4 of the reciprocating mechanism 3, and disposed on the plate member 10 extending rearward from the lower part of the case 4. Thus, while the engine 2 is pushed up from a ground under an impact force during compaction work, the plate member 10 is flexed to reduce the impact force and the reduced impact force is transmitted to the engine. This allows the engine 2 to be protected. The plate member 10 is provided with the bent part 10C bent in the right-left direction, and this ensures a preferable flexibility of the plate member 10.

(4) The gear shaft 21 has the driven pulley 19 rotatably attached at one end side and the pinion gear 24 attached at the other end side. The shaft ends of the gear shaft 21 and the shaft ends of the crank shaft 13 are supported by the case 4 by using the bearings 22 and 26, respectively. This structure, where both the ends of the gear shaft 21 and both the ends of the crank shaft 13 are rotatably supported by the case 4, allows the pinion gear 24 and the large diameter gear 25 to be stably engaged together.

EXPLANATION OF REFERENCE NUMBER

1 Rammer
2 Engine
3 Reciprocating Mechanism
4 Case
5 Leg Part
6 Compacting Plate
10 Plate Member
13 Crank Shaft
14 Connecting Rod
15 Crank Mechanism
16 Belt reduction Mechanism
17 Gear reduction Mechanism
21 Gear Shaft
24 Pinion Gear
25 Large Diameter Gear
27 Crank Pin

What is claimed is:

1. A rammer comprising:

an engine;

a reciprocating mechanism including a crank shaft and a connecting rod and configured to convert a rotational force of the engine into a reciprocal force;

a leg part disposed in a forward inclined position in a traveling direction and configured to be moved up and down by the connecting rod; and a compacting plate disposed on a bottom end of the leg part, wherein the crank shaft has a rotational axis disposed orthogonally to the traveling direction;

wherein the reciprocating mechanism comprises:

a driving pulley rotatably attached on an output shaft of the engine and having a rotational axis extending in a direction orthogonal to the traveling direction;

a driven pulley larger in diameter than the driving pulley and having a rotational axis extending in the direction orthogonal to the traveling direction;

a belt reduction mechanism including a belt wound between the driving pulley and the driven pulley;

a gear shaft connected to the driven pulley and having a rotational axis extending in the direction orthogonal to the traveling direction;

a pinion gear attached on the gear shaft and configured to rotate integrally and coaxially with the driven pulley; and a gear reduction mechanism including a large diameter gear disposed on the crank shaft and being engaged with the pinion gear.

2. The rammer according to claim 1, wherein the engine is disposed apart rearward from a case of the reciprocating mechanism and disposed on a plate member extending rearward from a lower part of the case.

3. The rammer according to claim 1 wherein the driven pulley is rotatably attached on one end side of the gear shaft, wherein the pinion gear is disposed on the other end side of the gear shaft, and wherein both ends of the gear shaft and both ends of the crank shaft are rotatably supported by the case.

* * * * *